US007975322B1

(12) United States Patent
Heller

(10) Patent No.: US 7,975,322 B1
(45) Date of Patent: Jul. 12, 2011

(54) FOOT PEDAL TOILET FLUSH DEVICE

(76) Inventor: Allison Heller, Marlboro, NJ (US)

( * ) Notice: Subject to any disclaimer, the term of this patent is extended or adjusted under 35 U.S.C. 154(b) by 520 days.

(21) Appl. No.: 12/181,943

(22) Filed: Jul. 29, 2008

(51) Int. Cl.
*E03D 5/00* (2006.01)

(52) U.S. Cl. ..... 4/249; 4/411

(58) Field of Classification Search ..... 4/249, 246.1, 4/246.2, 246.3, 411, 413, 661
See application file for complete search history.

(56) References Cited

U.S. PATENT DOCUMENTS

| | | | | |
|---|---|---|---|---|
| 2,283,678 | A | 5/1942 | Landis | |
| 4,571,753 | A * | 2/1986 | Strangfeld | 4/324 |
| 5,056,165 | A * | 10/1991 | Wescott, Sr. | 4/246.1 |
| 5,068,925 | A | 12/1991 | Salibi | |
| 5,170,513 | A | 12/1992 | Ambooken et al. | |
| D354,802 | S | 1/1995 | Bigelow | |
| 5,857,223 | A * | 1/1999 | Ferdinand | 4/246.1 |
| 5,906,011 | A | 5/1999 | Fleming | |
| 6,651,262 | B1 | 11/2003 | Tinsley | |
| 6,907,621 | B2 | 6/2005 | Stemen | |
| 7,003,815 | B2 | 2/2006 | Herbst | |
| 2006/0031981 | A1 | 2/2006 | Thompson | |

* cited by examiner

*Primary Examiner* — Gregory L Huson
*Assistant Examiner* — Karen Younkins

(57) ABSTRACT

The present invention is directed to a foot pedal toilet flush device, which comprises a first bar member, a second bar member, a set of hinge members, and a bias system to allow a person to flush a toilet using a foot pedal connected to the toilet's flushing system.

1 Claim, 6 Drawing Sheets

FIG. 1B
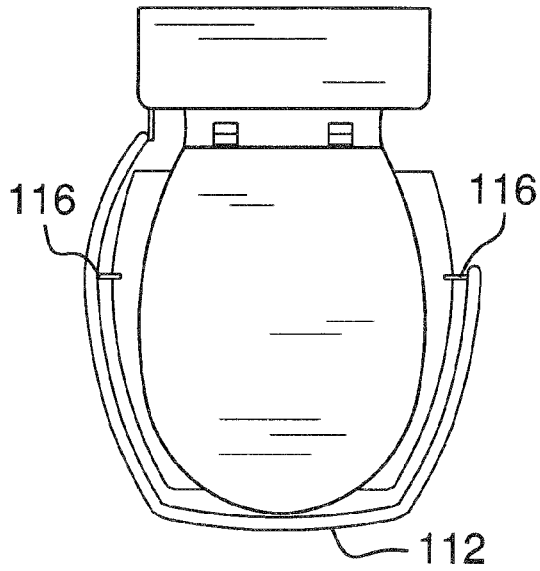
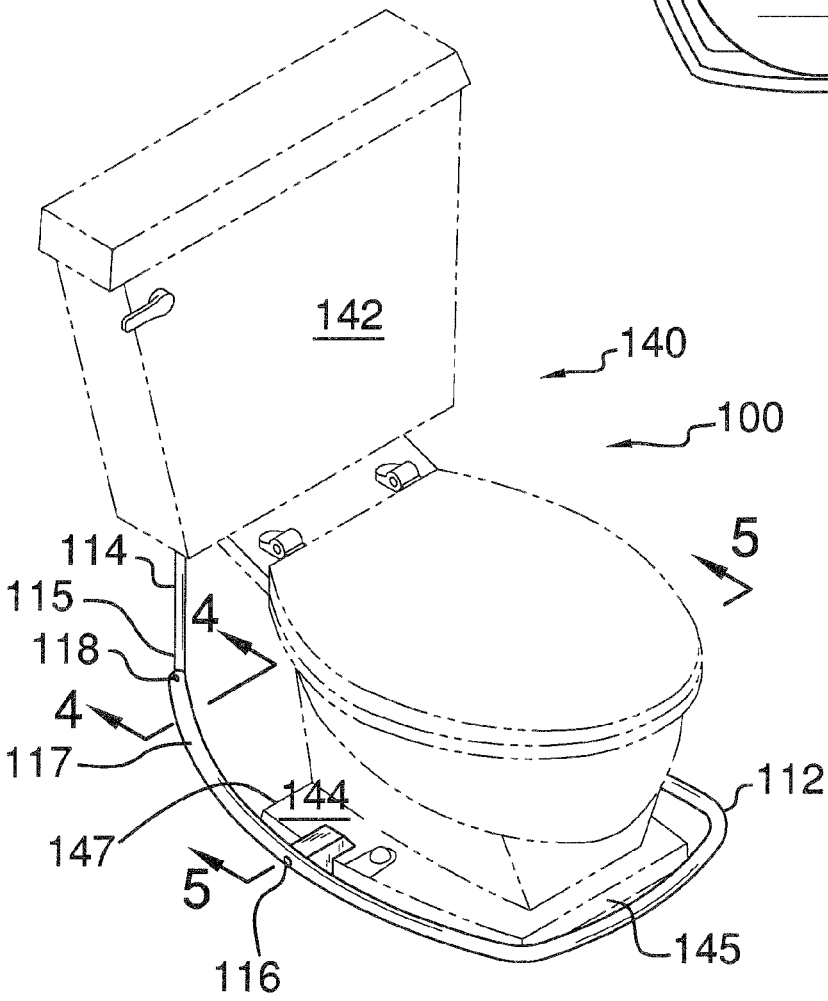
FIG. 1A

FOOT PEDAL TOILET FLUSH DEVICE

FIELD OF THE INVENTION

The present invention is directed to a foot pedal toilet flush device, which comprises a first bar member, a second bar member, a set of hinge members, and a bias system to allow a person to flush a toilet using a foot pedal connected to the toilet's flushing system.

BACKGROUND OF THE INVENTION

An object of this invention is to provide a foot pedal toilet flush device that allows a person to flush a toilet using a foot pedal connected to the toilet's flushing system.

SUMMARY OF THE INVENTION

The present invention features a foot pedal toilet flush device 100 comprising:

- a first bar member 112 wrapping around a front end 145 of a base 144 of a toilet,
- a first hinge member 116 disposed on each side of the base of the toilet base 144 and pivotably linking the first bar member 112 to the base 144 of the toilet,
- one end of the first bar 117 extends to a back 147 of the toilet base, wherein a second hinge member 118 rotatably links the first bar member 112 to a first end 115 of a second bar member 114, the second bar member 114 is inserted into the water tank 142 through a bias system 210, the bias system 210 causes the second bar member 114 to be pushed downwards in its resting position, and the second bar member 114 is pushed up when a person depresses a front end 113 of the first bar member 112 causing the one end of the first bar member 117 that extends to the back 147 of the toilet base to elevate and subsequently causing the second bar member 114 to be pushed up,
- a second end of the second bar member 117 has a two prong structure 119 that can engage a toilet lift arm 216 between the two prongs, when the second bar member 114 is pushed up it elevates the lift arm 216, which in turn yanks open a flapper 300 to execute the flushing (i.e., allowing water to rush into the toilet bowl,
- the bias system 210 sits on a bottom wall 143 of the water tank 142, the bias system has a top wall 211,
- a spring 300 compressing against a notch 119 on the second bar member 114 and against the top wall 211 of the bias system, causing the second bar member 114 to be plunged downward and pushing a front end 113 of the first bar member 112 in an up position.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

BRIEF DESCRIPTION OF THE DRAWINGS

FIG. 1 is an illustration of a foot pedal toilet flush device according to the invention, which comprises a first bar member, a second bar member, and a set of hinge members.

DESCRIPTION OF PREFERRED EMBODIMENTS

Figure 2A:
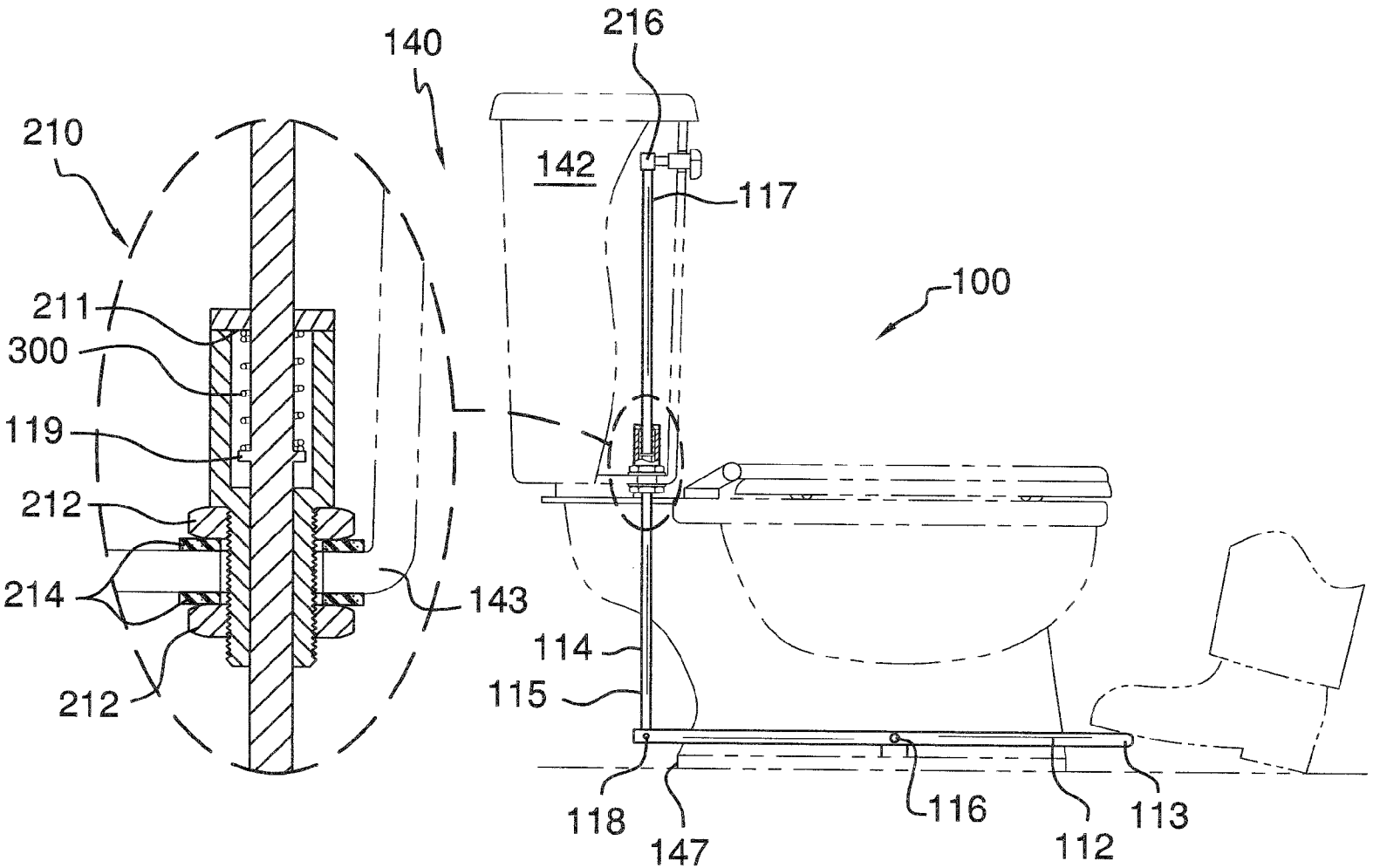
FIG. 2A is a side view of the foot pedal toilet flush device of FIG. 1, including a bias system.

Referring now to FIG. 1, foot pedal toilet flush device 100 is shown comprising first bar member 112, second bar member 114, first hinge member 116, and second hinge member 118. In the illustrated embodiment of FIG. 1, first bar member 112 is a wrap-around bar that wraps around the base 144 of toilet 140. First bar member 112 is connected on each side of toilet 140 by first hinge 116. First bar member 112 is connected to second bar member 114 by second hinge member 118. A person can use his/her foot to press first bar member 112 which will cause second bar member 114 to push up on the toilet lift arm 216 and cause toilet 140 to flush (see FIG. 2). First hinge member 116 allows first bar member 112 to rotate. Second hinge member 118 connects first bar member 112 and second bar member 114.

In certain embodiments, first bar member 112 comprises a rigid material selected from the group consisting of metal, plastic, and combinations thereof. In certain embodiments, second bar member 114 comprises a rigid material selected from the group consisting of metal, plastic, and combinations thereof.

Figure 2B:
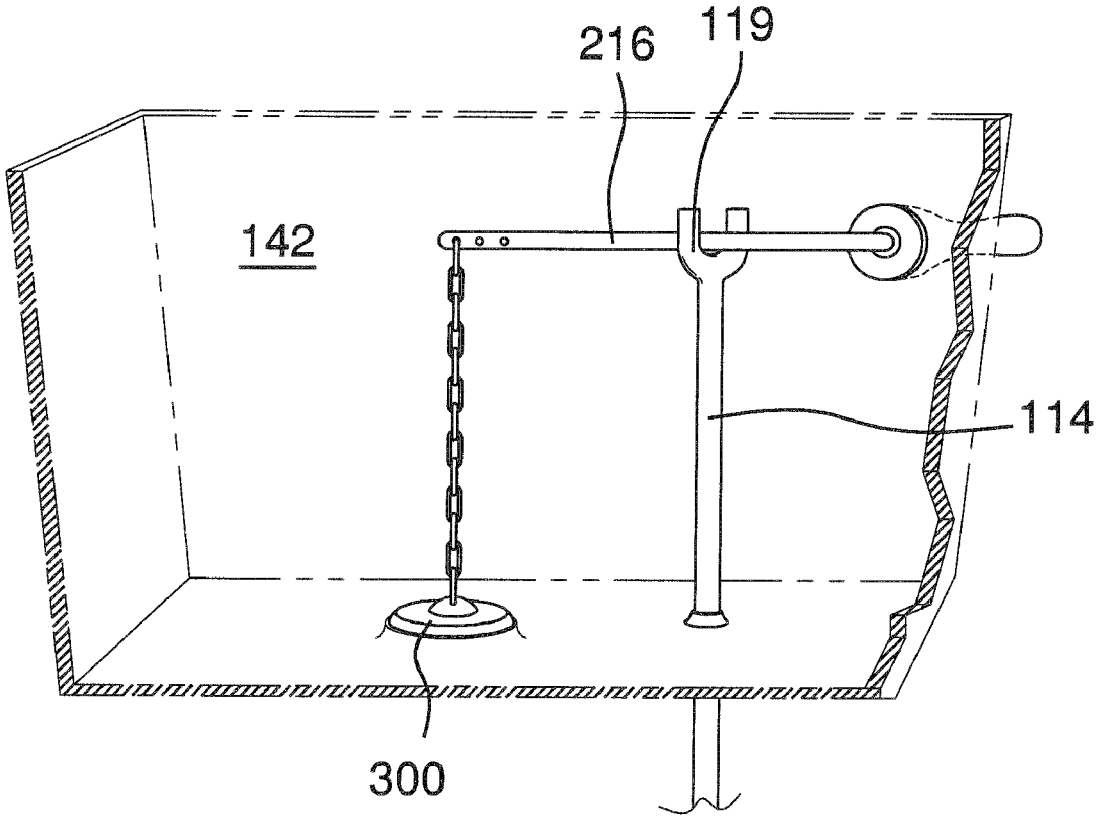
FIG. 2B is a an inside view of the FIG. 3 is a side view of the foot pedal toilet flush device of FIG. 1 as used.

Referring now to FIG. 2, a side view of foot pedal toilet flush device 100 is shown comprising first bar member 112, second bar member 114, first hinge member 116, second hinge member 118, and bias system 210. In the illustrated embodiment of FIG. 2, bias system 210 comprises set of bolts 212 and set of gaskets 214. A person can use his/her foot to press first bar member 112 which will cause second bar member 114 to pull down on toilet lift arm 216 and cause toilet 140 to flush. First hinge member 116 allows first bar member 112 to rotate. Second hinge member 118 connects first bar member 112 and second bar member 114. When first bar member 112 is pressed downward, second bar member 114 pressed upward through bias system 210 inside toilet 140 and causes toilet lift arm 216 to move. When toilet lift arm 216 moves, toilet 140 flushes.

Figure 3:
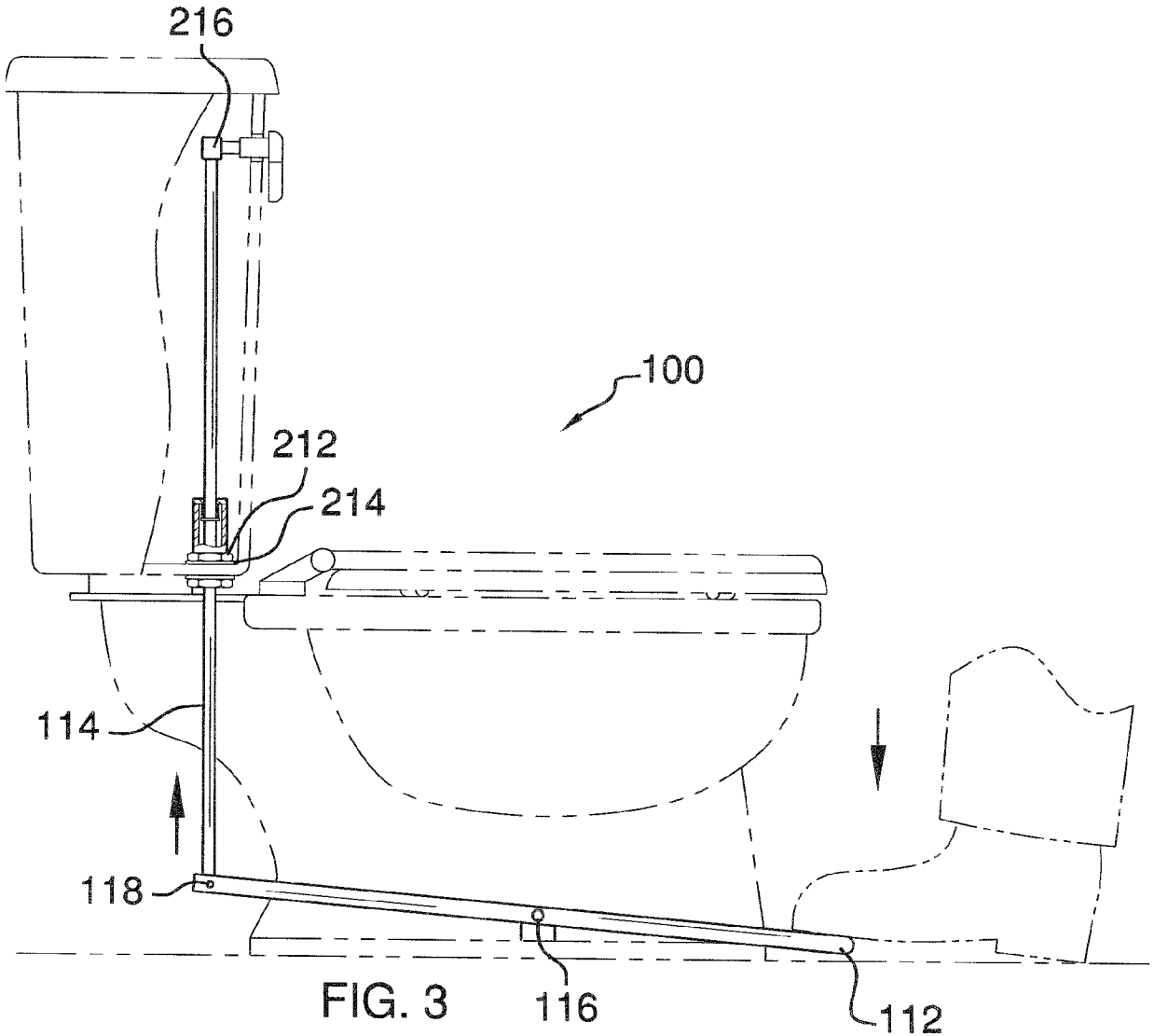

Referring now to FIG. 3, a side view of foot pedal toilet flush device 100 is shown as used comprising first bar member 112, second bar member 114, first hinge member 116, second hinge member 118, and bias system 210. In the illustrated embodiment of FIG. 3, bias system 210 comprises set of bolts 212 and set of gaskets 214. A person can use his/her foot to press first bar member 112 which will cause second bar member 114 to pull down on toilet lift arm 216 and cause toilet 140 to flush. First hinge member 116 allows first bar member 112 to rotate. Second hinge member 118 connects first bar member 112 and second bar member 114. When first bar member 112 is pressed downward, second bar member 114 pressed upward inside toilet 140 and causes toilet lift arm 216 to move. When toilet lift arm 216 moves, toilet 140 flushes.

Figure 4:
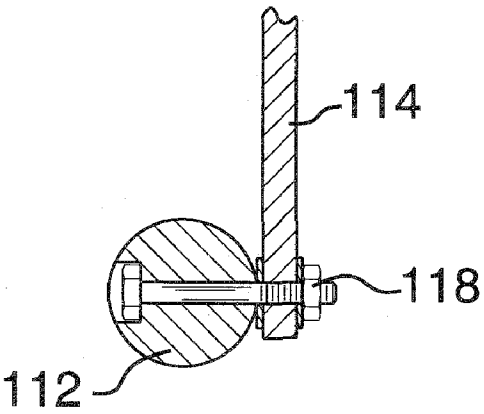
FIG. 4 is an illustration of a hinge of FIG. 1.

Referring now to FIG. 4, a cross section view of second hinge 118 is shown connecting first bar member 112 and second bar member 114. In the illustrated embodiment of FIG. 4, hinge 118 comprises a standard nut and bolt hinge mechanism known to one skilled in the art.

Figure 5:
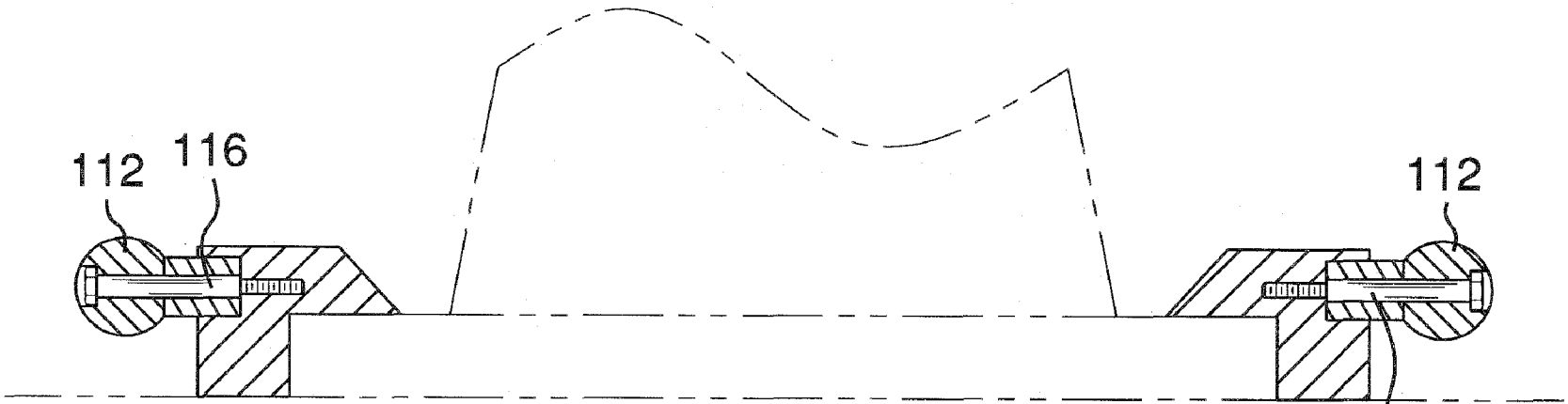
FIG. 5 is a back cross section view of the foot pedal toilet flush device of FIG. 1.
Figure 6:
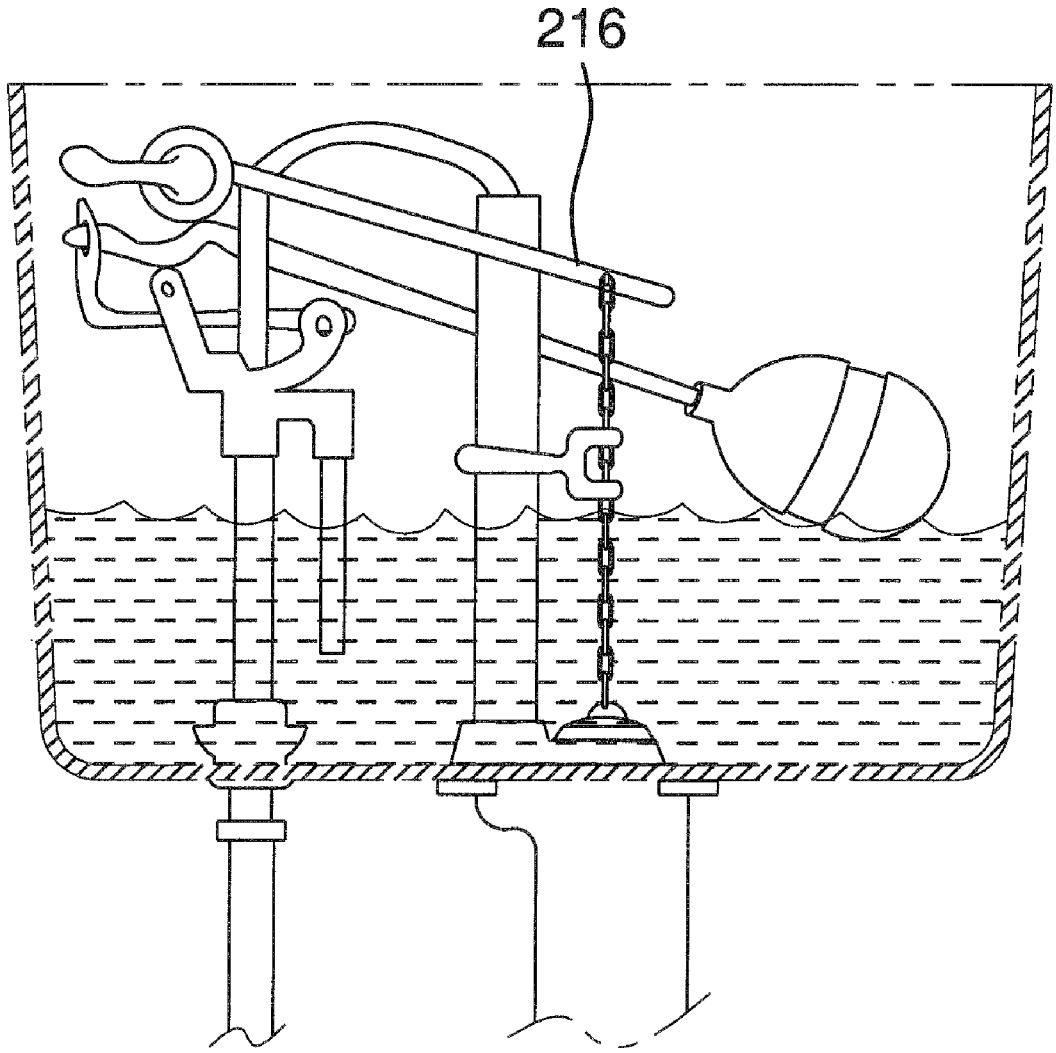
FIG. 6 shows a front cross sectional view of a standard toilet. Ballcock: Water supply valve. Float ball: The ball that rides on the surface of the water in the tank. When the tank is full, the float ball shuts off the ballcock. Flush valve: Connection that consists of the flapper and the flush valve seat. Flush valve seat: Brass or plastic sealant ring located at the bottom of the tank. Lift arm: Thin metal rod inside the tank that connects to the flush handle and raises the flapper valve. Main drain: The slanting pipe in the basement or crawl space that carries wastes to a sewer or septic tank; also called building drain. Main water valve: Located on the wall near the floor, this is a knob you twist to turn the water supply on and off. Overflow pipe: Long, hollow tube, fastened to the bottom of the tank. Flapper (also called stopper, tank-ball, seal or disk): Rubbery plug attached to the lift chain. Tank: Large, oblong ceramic container located behind the toilet bowl. Trap: Where waste water goes as it leaves the toilet bowl.

Referring now to FIG. 5, a back cross section view of foot pedal toilet flush device 100 is shown comprising first bar member 112 and first hinge member 116. In the illustrated embodiment of FIG. 5, first hinge member 116 comprises a standard nut and bolt hinge mechanism known to one skilled in the art. In the illustrated embodiment of FIG. 5, first bar member 112 wraps around the base of toilet 140 and moves up and down by way of first hinge member 116.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A foot pedal toilet flush device comprising:

a first bar member wrapping around a front end of a base of a toilet, a first hinge member disposed on each side of the base of the toilet and pivotably linking the first bar member to the base of the toilet, one end of the first bar extends to a back of the toilet base, wherein a second hinge member rotatably links the first bar member to a first end of a second bar member, the second bar member is inserted into the water tank through a bias system, the bias system causes the second bar member to be pushed downwards in its resting position, and the second bar member is pushed up when a person depresses a front end of the first bar member causing the end of the first bar member that extends to the back of the toilet base to elevate and subsequently causing the second bar member to be pushed up, a second end of the second bar member has a two prong structure that engages a toilet lift arm between the two prongs, when the second bar member is pushed up it lifts the toilet lift arm, which in turn yanks open a flapper to execute the flushing, the bias system sits on a bottom wall of a water tank, the bias system has a top wall, a spring compressing against a notch on the second bar member and against the top wall of the bias system, causing the second bar member to be plunged downward and pushing the front end of the first bar member in an up position.

* * * * *